United States Patent [19]

Onderak et al.

[11] 4,403,009

[45] Sep. 6, 1983

[54] SKID RESISTANT RESILIENT FLOOR COVERING

[75] Inventors: Dale G. Onderak, Munroe Falls; David L. Pangallo, Ravenna, both of Ohio

[73] Assignee: Becton Dickinson and Company, Paramus, N.J.

[21] Appl. No.: 444,409

[22] Filed: Nov. 24, 1982

[51] Int. Cl.[3] ..... B32B 3/00; B29C 17/00

[52] U.S. Cl. ..... 428/159; 156/285; 156/292; 156/322; 428/71; 428/166

[58] Field of Search ..... 428/71, 158, 159, 160, 428/166; 156/285, 292, 322

[56] References Cited

U.S. PATENT DOCUMENTS

| | | | |
|---|---|---|---|
| 2,189,813 | 2/1940 | McGuire | 428/166 |
| 2,946,713 | 7/1960 | Dusina, Jr. et al. | 428/159 |
| 4,192,701 | 3/1980 | Martin et al. | 156/285 |

OTHER PUBLICATIONS

Jason Industrial Inc., Fairfield, N.J., Brochure, "The Original Studded Rubber Flooring", (no date), 6 pp.

*Primary Examiner*—William J. Van Balen

[57] ABSTRACT

A floor covering is provided for areas requiring superior skid resistance, in combination with providing a high level comfort factor such as in galleys and entrances of aircraft, or the bridge and passageways of boats where long periods of standing are required under slippery unsteady conditions. The floor covering is comprised of a series of sections which may be formulated together into a pattern fitting the area in which the floor covering is to be used. Each section is comprised of a plurality of uniformly spaced cells over a central plane with the latter bounded on four sides by a dam area. For this reason, water or other liquids dropped on the floor covering stands in the plane area removed from the walking surface formed by the dams and cells to reduce slipping. In addition, each cell is resilient to enhance the gripping quality, and to provide a comfortable cushioning action for the user.

18 Claims, 4 Drawing Figures

SKID RESISTANT RESILIENT FLOOR COVERING

BACKGROUND AND STATEMENT OF THE INVENTION

Generally speaking, this invention relates to floor coverings, and methods for making them. More particularly, this invention relates to a floor covering specifically designed to provide improved skid resistance in areas where conditions require a positive footing for personnel using the areas, and where the area in question is likely to have spilled liquids of one kind or another. Such areas include, for example, entrances and qalleys in aircraft where the floor covering is likely to be exposed to the elements from an open entry way, or from liquids being served by the staff to aircraft passengers. Other areas likely to utilize such materials include galleys or bridges of boats, or entrance and exit ramps of buildings which may be exposed to the elements.

This invention is also directed to a method for producing such floor covering, and the covering can be made in a specific pattern from specifically defined sections of the material of the invention. That is, a specific area under consideration for the floor covering is duplicated in a pattern of individual mold sections placed together in the outline of the area requiring the floor covering. Subsequently, the floor pattern can then be made of the width, length and configuration of the area involved, such as a combined entrance way and galley for aircarft, for example.

As will be appreciated by those who use aircraft, not only the personnel thereof but also the passengers, it is important to have sure footing. This is particularly so in areas where moisture is likely to form such as in galley areas where drinks or water may be spilled during the serving of food and/or liquids. When such floor coverings are the usual routine floor coverings comprised of a resin or elastomer material, the surface is likely to be smooth. Thus, such floors are likely to be slippery when liquid is dropped on them. This causes a dangerous condition, particularly during periods when the aircraft is encountering turbulence.

With this invention, by contrast, a fllor covering is provided which accommodates the spilling of liquids by having a raised patterned surface throughout the extent thereof surrounded by a plane area which receives any spilled liquid. Thus, the raised surfaces support the soles of shoes of people treading on the floor covering above the liquid which gathers on the plane. In addition, the floor covering of the invention is comprised of individual sections of equal dimensions joined together. Each section is surrounded by a dam area which contains any liquids formed so that the liquids do not move from one area to another during routine movement of the aircraft.

As a further important feature of the invention, each section of the floor covering is comprised of a plurality of cells which are resilient, and give when weight is placed upon them. This resiliency provides a comfort factor in the floor covering for those who must stand for long periods of time, as during a long aircraft flight. Because the floor covering of the invention may be made into a desired pattern, the entire floor covering can be formulated initially and then installed in its entirety at the desired location. Also, sections of a pattern may be formed together when the dimensions of the area where the skid resistant covering is to be installed are very large requiring such joining together of sections.

In considering the conditions, generally, for forming the skid resistant floor covering of the invention, prior to the formulation of the covering on the molds in the machine pattern, an initial mat material is formed of a wear layer and a foamed layer. The wear layer will be of a thickness of within the range of between about 0.01 and 0.03 inches. Preferably, the wear layer will be 0.02 inches. The wear layer is formed, preferably, of a polyvinyl chloride resin. Other resins include, for example, polyurethane or synthetic elastomers. The resin will contain appropriate flame retardants, heat stabilizers, plasticizers, fillers and pigments to the desired color.

The wear layer will have joined to it a foam layer also comprised of a polyvinyl chloride resin. Again, other resins which may be used include polyurethane and synthetic elastomers. Preferably, the foam layer will have a thickness within the range of between about 0.05 and 0.2 inches. Most preferably, the foam layer will be 0.1 inch in thickness. At any rate, the wear layer formulation and the foam layer formulation both include appropriate flame retardants, stabilizers, fillers and pigments, as more specifically discussed below. The wear layer is in the form of a flat piece of material joined with the foam layer to form a mat, for subsequent vacuum forming of the mat into the skid resistant floor covering of the invention.

Once the mat is formulated with the joining of the wear and foam layers, the form of the particular pattern configuration desired for the area in question is set up on the vacuum forming table. The pattern will be comprised of a plurality of molds laid out on a vacuum forming table in the configuration desired. Once this has taken place, the remaining portion of the vacuum forming table is filled in with an air impervious material so that only the mold pattern itself will be subjected to the vacuum. In this connection, each mold section is of a dimension which will provide the desired sections, preferably in a square configuration 8.75 inches in each direction. It will be understood by practitioners in the art, however, that other geometric forms may be developed, including circular, oval, triangular and rectangular, for example. Each mold is comprised of, in turn, a plurality of spaced apart cells which form the cells of the floor covering sections. The center of each cell former in the mold has a pinhole opening allowing the passage of air therethrough to create the vacuum which produces the cells in the mat material laid out on the mold.

Once the base material or mat comprised of the wear layer and foam layer is placed on the mold, it is heated for two minutes with no vacuum. Subsequently, a vacuum is applied of a specific degree in order to achieve the mold pattern required for the skid resistant floor covering.

After the inital formulation of the floor covering, a scrim fabric forming the backing of floor covering is laid on top of the mat with a precoated adhesive. The scrim has the effect, together with a subsequent application of a barrier material to maintain the cell integrity of the various sections of the floor covering of the invention. Once the scrim has been properly applied to the vacuum formed mat, the barrier material film is applied to the scrim layer. The barrier film may be a 4 mil thick polyvinyl chloride barrier film which is laminated to the fabric, preferably by the application of heat in order to provide the final mat material configured as required for a specific area installation.

Other objects and advantages of this invention will be apparent from the following description, the accompanying drawings, and the appended claims.

DETAILED DESCRIPTION OF THE INVENTION

Figure 1:
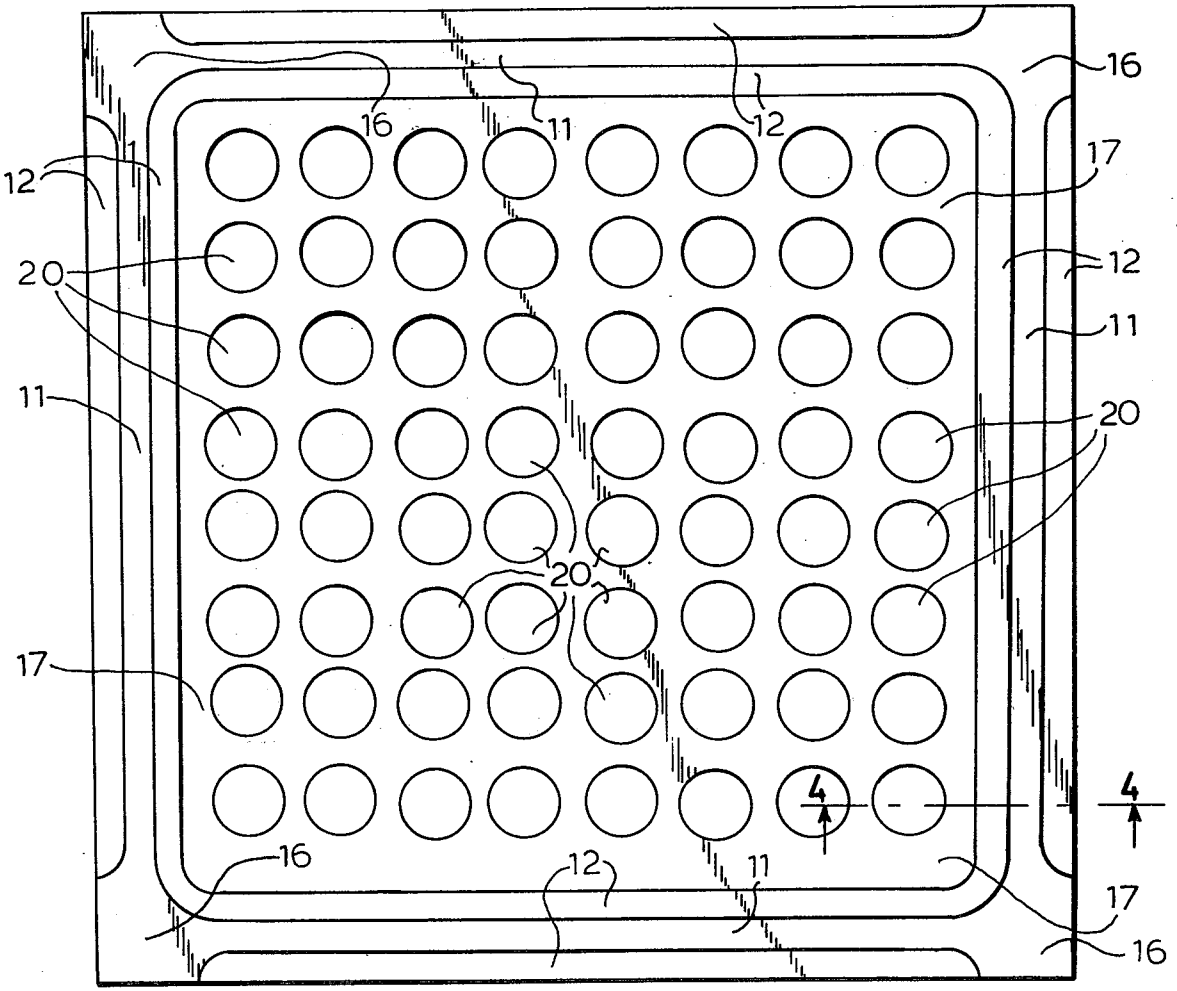
FIG. 1 is a top plan view of one section of the floor covering of the invention, illustrating the cell and dam structure of each section.

Referring to the drawings in which like reference characters refer to like parts throughout the several views thereof, in FIG. 1, a section of the floor covering of the invention is illustrated and referred to generally at 10. As can be seen, the section is square and includes a dam area 11 along each of the four sides thereof, with each dam 11 ending at each end thereof in a corner dam area 16. Thus, the plane or floor 17 of the section is completely surrounded by the dams 11. Contained within the dam area are a plurality of spaced apart raised cells 20 which are resilient when weight is placed upon them. Thus, any liquid dropping onto the surface of this section 10 will be contained within the dams 11 together with the corner sections 16 thereof. Anyone walking on this particular section of the floor covering of the invention will walk on the cells 20 and the dams 11, and avoid the moisture on the floor covering which will flow to the plane area 17. As will be appreciated, this construction provides a skid resistant property for those walking or treading on this particular floor covering. As will be noted further in FIG. 1, each dam is bordered on each side thereof with a bank area 12 which provides a curved gradual transition from the top surface of the dams 11 and the plane or flat surface 17 of each section 10.

Figure 2:
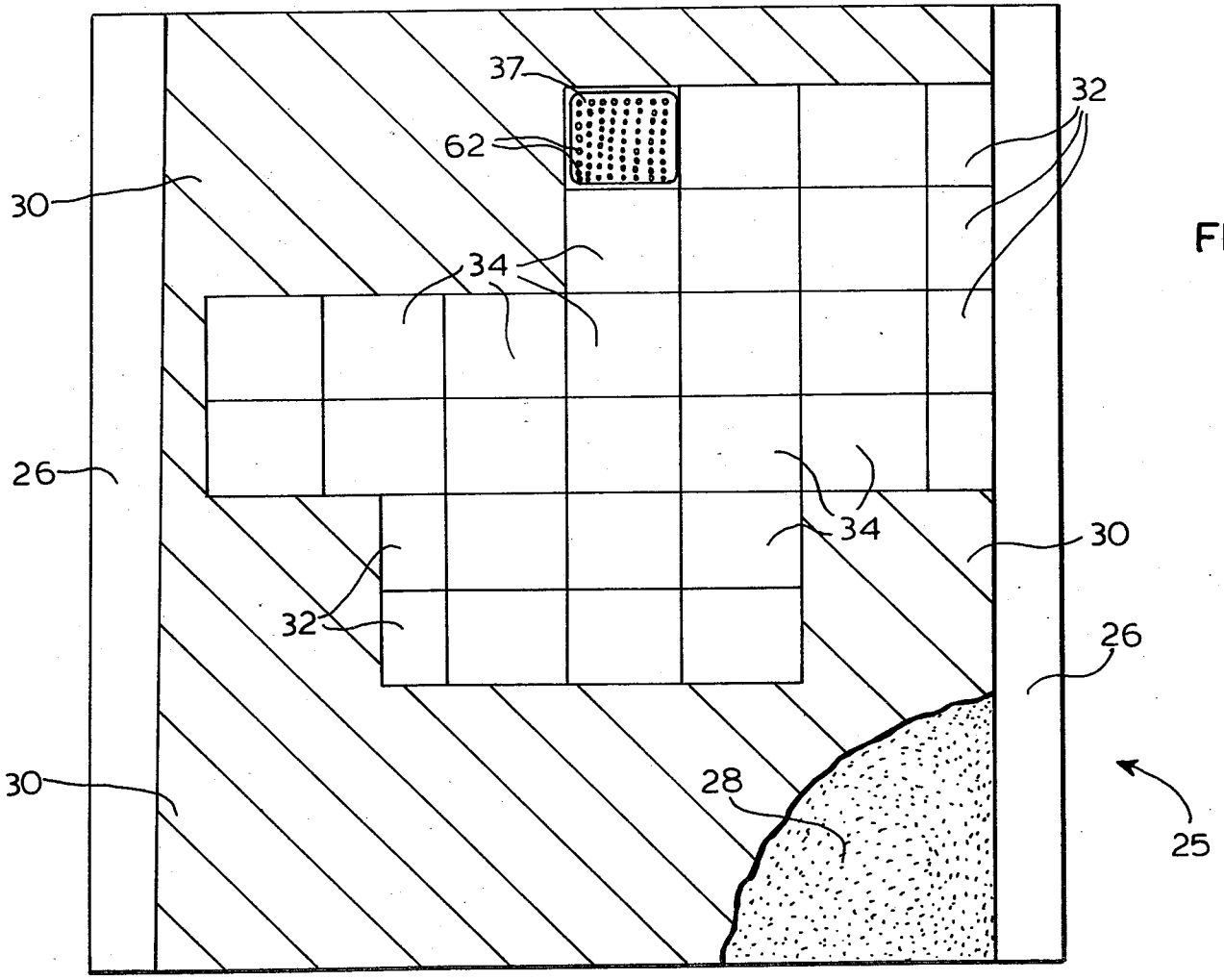
FIG. 2 is a top plan view of a vacuum forming table illustrating an exemplary outline of a floor covering configuration required, for example, in an aircraft entry and galley way area.

Referring now to FIG. 2, a section of the top surface of a vacuum forming table is generally designated 25. The top surface of the table is comprised of a porous air pervious material 28 which may be, for example, a pressed wood material. The border areas 26 of the table are air impervious to provide a border sealing area along the edge outline of the mat being formed on the table. In order to provide the proper mold configuration, each mold section 34 is laid out side by side with adjacent mold sections in order to provide a particular desired configuration of floor covering, depending upon the area where it is to be installed. Half sections 32 may be provided in order to better configure the outline of the floor covering to the area to be covered.

Each mold 34 is configured in the reverse to the sections 10, as shown in FIG. 1 in order to provide the particular desired configuration of each section of the floor covering being produced. Furthermore, each cell producing recess portion 37 is a sunken cell forming area in order to produce each cell 20 in the sections 10. Each recess 37 includes a pinhole air passage 62 for drawing air therethough to create the vacuum to form each individual cell of the sections 10 of the floor covering of the invention.

Figure 3:
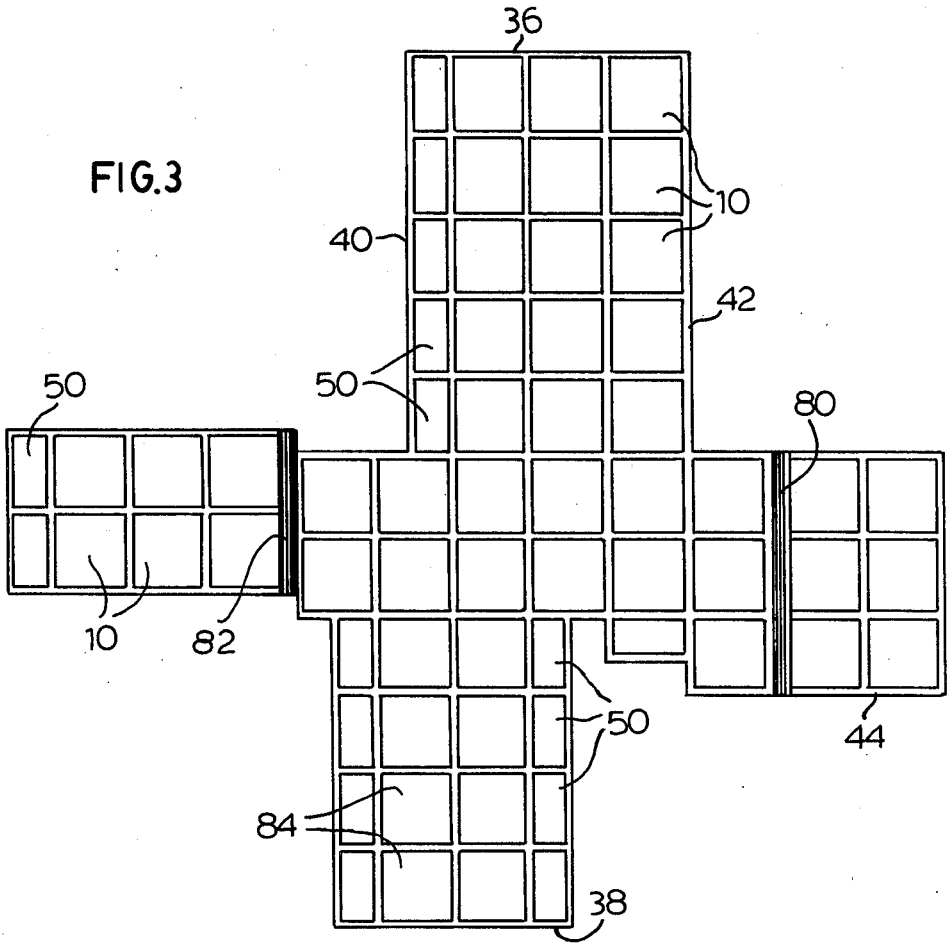
FIG. 3 is the specific floor covering outline prepared, in accordance with the method of the invention for use in the galley-entry way of a DC-9-31 aircraft, and illustrating the seaming of several sections together in order to accommodate the specific dimensions of that aircraft.

Referring now to FIG. 3, an outline is shown of a typical layout for a combined entry and galley area of an aircraft. In this case, the outline is specifically for a DC-9-31 aircraft. Thus, the entry door is positioned at 38 in the outline shown. The center configuration of the outline is joined together by seaming to two sections on either side thereof, as shown at seams 80 and 82. The entry passage area 84 includes a plurality of half sections 50 formed by the half molds 32 as shown in FIG. 2. The border areas 40, 42 and 44 are edges positioned along the three galleys of the aircarft. The border edge 36 borders the galley exit door. As will be appreciated, all of these areas are subject to moisture, not only from the elements coming through the open galley door or entry door, but also during the serving of liquids and food products in the galley areas. These are all areas where the aircraft passengers and personnel are subjected to slippery conditions during passage through these areas. It will be appreciated therefore, that these areas are particularly appropriate for an improved skid resistant material.

Figure 4:
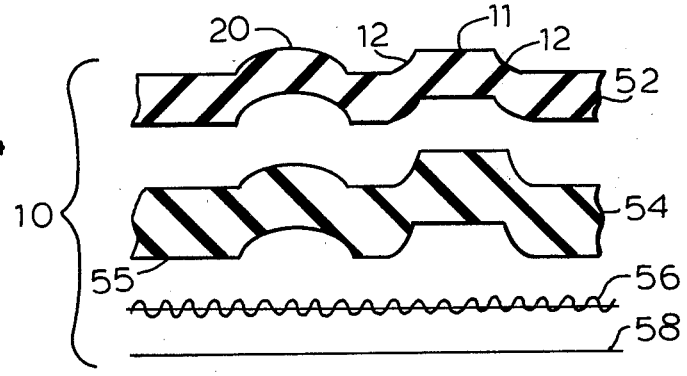
FIG. 4 is an exploded cross section of the mat of FIG. 1 taken along lines 4—4 of FIG. 1.

Referring to FIG. 4, a simplified exploded sectional view of a portion of the floor covering is shown enlarged to show the relative positioning of the various layers of the laminated structure of the invention. The wear layer 52 is the surface layer, while foam layer 54 provides the resilient backing. The scrim 56 is applied to surface 55 of foam layer 54 except in the areas of the dams 11 and cells 20. This has the effect of maintaining the integrity of the dams and cells. The film layer 58 is the last and bottom layer of the floor covering and serves to seal the cavities formed between surface 55 of foam layer 54, and the scrim 56. In addition, film layer 58 provides a smooth uniform backing so that the floor covering may be easily bonded with adhesives to the floor of the installation area.

As purely illustrative of a wear layer formulation which may be utilized for the mat material, in accordance herewith, one may note Example I below. It will be understood, however, that the formulation may be varied, depending upon the specific properties required for a specific application of floor covering. In this case, a substantial portion of the formulation includes flame retardants and heat stabilizers. Other components may include pigments, for a desired color application.

EXAMPLE I

| MATERIAL | PARTS PER HUNDRED |
|---|---|
| Hooker Exon #654 polyvinyl chloride resin | 65.00 |
| Goodyear M70 polyvinyl chloride resin | 35.00 |
| N—Octyldecylphthalate plasticizer | 27.00 |
| Santicizer 141 flame retardant | 10.00 |
| Paraplex G62 heat stabilizer | 5.00 |
| Lecithin viscosity depressant | 0.50 |
| Ferro 6V6A heat stabilizer | 3.50 |
| Antimony oxide flame retardant | 8.00 |

As further illustrative of a foam layer formulation which may be utilized in accordance herewith, one may note the formulation given in Example II below.

EXAMPLE II

| MATERIAL | PARTS PER HUNDRED |
|---|---|
| Polyvinyl chloride dispersion resin | 100.00 |
| N—Octyldecylphthalate plasticizer | 60.00 |
| Flame retardant, Stabilizer, Blowing agent, Filler, Pigments | 54.00 |

It should be understood, that these formulations, both for the foam and wear layer, are given as illustrative only and variations can be made, as discussed above, for specific applications.

In order to join the resulting combined mat material to the scrim, a representative adhesive layer formulation includes a carboxylated vinyl chloride resin designated Union Carbide VMCH in the amount of 30% by weight, methylethyl ketone in the amount of 70% by weight, and a black pigment in the amount of 0.5% by weight. A representative scrim fabric may be Burlington Industrial Fabric Style 66270 comprised of 100% polyester. The polyvinyl chloride barrier film which is applied last over the scrim may be Style Number 20K15-5200 Clear, made by General Tire Chemical Plastics Division. The film will have a thickness of about 0.004 inches, as discussed above.

In forming the floor covering of the invention, generally three steps will be used. That is, there will be a mat forming step, followed by the bonding of the scrim, followed by the application of the barrier film. As an alternative, the scrim and barrier film may be applied simultaneously. However, in certain applications, this is not satisfactory because there is not a proper joining of the various components of the final material together.

In forming the initial mat, the raw stock in the form of the combined wear and foam layer is placed on the mold pattern already formed on the vacuum table. The general raw stock dimension will have a length of within the range of 123 and 126 inches for a DC9-31 aircraft installation. Of course, this can be varied. However, certain limitations take place relative to the dimension of the vacuum forming table. Once the raw stock is in place over the mold pattern already set on the vacuum forming table, the heaters are initiated. These include heaters at the end of the table and in the center thereof. The vacuum forming table is hydraulically driven into and out of the heater range. The heaters positioned near the end of the table are set at 70% while the center heaters are set at 60%. That is, the end heaters will operate at 70% of each 30 second cycle, while the center heaters will operate at 60% of each 30 second cycle. The temperature applied is within the range of between about 300 and 400 degrees F. During the initial application, no vacuum is applied for the first two minutes. Subsequently vacuum is applied of greater than 20 inches mercury for a full vacuum application cycle of six minutes. After the six minute full vacuum and heat application cycle, a cooling cycle of five minutes is applied along with full vacuum. Thereafter, while the vacuum is still on, the material is trimmed to one-half inch around the perimeter of the mold outline.

Following the initial forming of the mat configuration on the molds, the scrim is then bonded to the previously formed mat. This is carried out by placing the adhesive coated scrim on top of the mat so that the adhesive coated side of the scrim is against the mat. This is then followed by the positioning of a release paper, which may be Vel paper manufactured by the SD Warren Division of the Scott Paper Company followed by a blanket laid over the release paper which may be a HYNIT blanket which is a rubber coated cotton fabric, a product of the Edmont Division of Becton, Dickinson and Company which provides good heat resistance. During this bonding of the scrim, the end heaters are at 70% setting, and the center heaters are at 60%.

This operation includes trimming the paper and scrim to the proper size. The scrim must be cut so that the length and the width overhang the mat by one-quarter inch around the periphery thereof, and the paper is cut to the same size as the trimmed mat. The blanket is placed so that the rubber side is up and the Vel paper is placed with the release side down. Subsequently, heat is applied for five minutes followed by five minutes cooling.

Before the heating cycle is started, air is removed from under the blanket. This may be observed easily by watching for the outline of the mat, with the cell recesses formed on the mold, which appears on the top of the blanket. If the blanket is still smooth, all of the air has not been removed. The cooling cycle allows the scrim adhesive to set, yet allows the mat to remain warm enough for the following application of the barrier film.

During the bonding of the barrier film, the heaters are set at 70% for the end heaters and 60% for the center heaters. It is important that the proper heating is applied so that there is no delamination of the scrim by overheating. The heating cycle will be for within the range of between about one minute, 45 seconds to two minutes, 30 seconds, depending upon the other conditions of the equipment at the time.

Thus, after the five minute cooling period from the application of the scrim, the blanket and release paper are removed. The vacuum is turned off and the clear 4 mil film is placed over the mat. After the film sets on the warm mat for about one minute it becomes flexible. Then the vacuum may be turned on about one third and the clear film can be smoothed out and sealed around the edges. After the film is sealed, the vacuum is adjusted to 10 inches. If the vacuum is too high the scrim and film will be drawn down into the cells formed in the mat.

The optimum temperature during this procedure may be controlled by the use of a thermocouple and it is preferably set within the range of between about 280° and 290° F. During this operation, care must be taken to stop the heating application when entrapped air in the cells expands so that the scrim with the applied film become level with the flat areas or floor plane of each section of the mat. Otherwise, there is too much air expansion causing the scrim and barrier film to raise from the mat.

Subsequent to the application of the film to the back surface of the mats, a ten minute cooling period is allowed prior to handling and removal of the mat from the mold.

While the methods and compositions herein described constitute preferred embodiments of this invention, it is to be understood that the invention is not limited to these precise methods and compositions, and that changes may be made therein without departing from the scope of the invention which is defined in the appended claims.

What is claimed is:

1. A laminate for skid resistant floor coverings, characterized by
(a) a wear layer of a thermoplastic material with a wear surface and a backside surface;
(b) a foam layer of a thermoplastic material adhered to the backside surface of said wear layer to form therewith a mat;
(c) a scrim layer adhered to the surface of said mat on the side of said foam layer opposite said wear layer;
(d) a barrier film adhered to said scrim layer on the side thereof opposite said foam layer;
(e) said mat having impressed therein a plurality of juxtaposed sections;
(f) each said section bounded by a dam for containing liquids in individual sections; and
(g) each said section having a plurality of raised cells in spaced apart relation to each other over the surface thereof.

2. The laminate of claim 1, further characterized by
(a) said thermoplastic material of said wear layer and said foam layer is polyvinyl chloride.

3. The laminate of claim 1, further characterized by
(a) said scrim layer and said barrier film, in the areas of said cells and said dams, extending parallel to the adjacent surface of said foam layer to form cushioning air pockets under said cells and said dams.

4. The laminate of claim 1, further characterized by
(a) said plurality of juxtaposed sections joined together in a specific pattern for installation in a specifically defined area.

5. The laminate of claim 1, further characterized by
(a) said wear layer is of a thickness within the range of between about 0.01 and 0.03 inches.

6. The laminate of claim 5, further characterized by
(a) said foam layer is of a thickness within the range of between about 0.05 and 0.2 inches.

7. The laminate of claim 6, further characterized by
(a) said wear layer, is of a thickness of 0.02 inches; and
(b) said foam layer is of a thickness of 0.1 inch.

8. The laminate of claim 1, further characterized by
(a) said barrier film is a 4 mil thick polyvinyl chloride film.

9. The laminate of claim 1, further characterized by
(a) said scrim is polyester.

10. The laminate of claim 1, further characterized by each said section is 8.75 inches square.

11. A method for producing a skid resistant cushioned floor covering for aircraft galleys and the like, comprising
(a) forming in a first forming step a wear surface layer material of thermoplastic resin;
(b) forming in a second forming step a foam cushion layer material of thermoplastic resin;
(c) joining said wear surface layer to said foam cushion layer to form a mat; the improvement characterized by
(d) positioning a mold pattern of a plurality of juxtaposed mold sections on a vacuum table;
(e) each said mold section bounded by a dam forming channel therearound;
(f) each said mold section having a plurality of cell forming recesses in spaced apart relation to each other over the surface thereof;
(g) each said recess having a centrally disposed air passage therein;
(h) placing said mat from said forming step over said mold pattern
(i) applying in a first applying step elevated temperatures to said mold pattern;
(j) applying in a second applying step a vacuum to each said recess through the centrally disposed air passages therein to form dam and cell containing areas in said mat;
(k) partially cooling said mold pattern while laying a scrim layer over the exposed surface of said mat;
(l) adhering in a first adhering step said scrim layer to said mat surface at elevated temperatures in the areas devoid of said dams and cells; and
(m) adhering in a second adhering step a barrier film to the exposed surface of said scrim layer.

12. The method of claim 11, further characterized by
(a) said first forming step is carried out to provide a wear layer of a thickness within the range of between about 0.01 and 0.03 inches.

13. The method of claim 11, further characterized by
(a) said second forming step is carried out to provide a foam layer within the range of between about 0.05 and 0.02 inches.

14. The method of claim 11, further characterized by
(a) said first applying step, being carried out at a temperature within the range of between about 300° and 400° F.

15. The method of claim 11, further characterized by
(a) said first applying step being carried out with heaters at the end edges of said mold pattern set at 70% of every 30 second cycle and the heaters at the central portion thereof at 60% of every 30 second cycle.

16. The method of claim 11, further characterized by
(a) said second applying step being carried out with a vacuum at greater than 20 inches of mercury.

17. The method of claim 11, further characterized by
(a) applying an adhesive to said scrim; and
(b) applying said adhesive coated scrim surface to said exposed mat surface at elevated temperatures.

18. The method of claim 17, further characterized by
(a) said first adhering step includes adhering said scrim under a blanket for improving adherance.

* * * * *